United States Patent [19]

Handler

[11] 4,386,620

[45] Jun. 7, 1983

[54] HAIR STYLING BRUSH

[76] Inventor: Carol Handler, 84 Armour St., Long Beach, N.Y. 11561

[21] Appl. No.: 233,872

[22] Filed: Feb. 12, 1981

[51] Int. Cl.[3] ..... A45D 44/18

[52] U.S. Cl. ..... 132/85; 248/359

[58] Field of Search ..... 132/85; 224/50; 248/110, 359, 360

[56] References Cited

U.S. PATENT DOCUMENTS

| | | | |
|---|---|---|---|
| 1,690,311 | 11/1928 | Reich | 248/359 |
| 2,294,661 | 9/1942 | Hibbard | 248/359 |
| 2,829,655 | 4/1958 | Bau | 132/85 |
| 3,468,508 | 9/1969 | Huver | 248/314 |
| 4,196,489 | 4/1980 | Hahn | 132/85 |
| 4,289,153 | 9/1981 | Paccione | 132/85 |

FOREIGN PATENT DOCUMENTS

| | | | |
|---|---|---|---|
| 2329515 | 12/1974 | Fed. Rep. of Germany | 132/85 |

*Primary Examiner*—Gregory E. McNeill

[57] ABSTRACT

A hair styling brush with an improved handle of a selected large-sized diameter and gripping surface elastomeric construction material, which obviates finger cramps and significantly contributes to comfort in the use thereof.

1 Claim, 5 Drawing Figures

HAIR STYLING BRUSH

Figure 1:
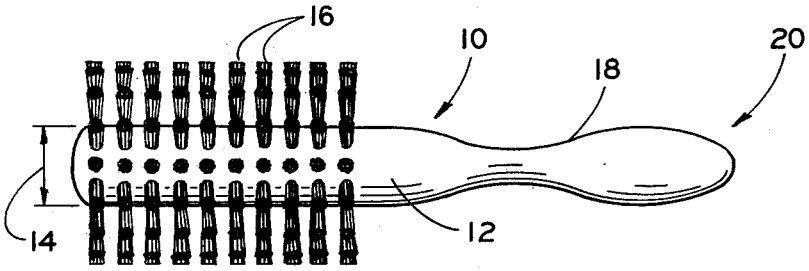
Fig. 1 PRIOR ART

The present invention relates generally to hair styling brushes of the type having bristles extending radially of a support core, and more particularly to improvements in the handle configuration of such brushes which significantly enhance the use thereof.

A widely used hair styling brush construction includes use of a small-diameter core which has bristles inserted to extend radially at one end and at its opposite end is fashioned into a gripping handle. The small diameter, which typically is one inch, is appropriate dimension-wise for the radial mounting of the bristles but has been recognized, in accordance with the present invention, as being a significant factor contributing to the user experiencing finger cramps and encountering other difficulties in use of the brush.

Broadly, it is an object of the present invention to provide an improved hair styling brush overcoming the foregoing and other shortcomings of the prior art. Specifically, it is an object to provide a handle on the within type hair styling brush that enhances the comfort and effectiveness of its use, rather than being the mere manifestation of practice believed to be ill-advisedly followed to achieve economy in manufacture. That is, the prior art practice of using an extension of the core mounting the bristles also as the handle of the brush is believed, according to the present invention, to severely detract from both comfort and effective use of the brush.

A hair styling brush demonstrating objects and advantages of the present invention is, as already noted, of the type having a cylindrical core of a first small-sized diameter extending for the longitudinal length thereof. Radially extending bristles are provided along one end of the core while the opposite core end is appropriately fashioned into a gripping handle for the brush. To such brush there is provided, according to the present invention, a cylindrical attachment member having an operative position over and in encircling relation about what heretofore was the gripping handle. Said attachment member has a comparatively large-sized diameter of an extent which correspondingly increases the curvature required in the fingers of the user when placed in gripping contact therewith incident to use of the brush, and results in significantly minimizing cramping in the user's fingers. The large-sized diameter of the attachment member additionally contributes to enabling the rotation of the bristles of the brush in hair-brushing strokes in response to an optimum minimum rotative force, and thus makes it significantly easier to use the brush. The ease of use afforded by the improvements of the within invention is of particular importance and benefit to individuals with arthritis in their hands and fingers, or hindered by a similar physical infirmity.

Figure 2:
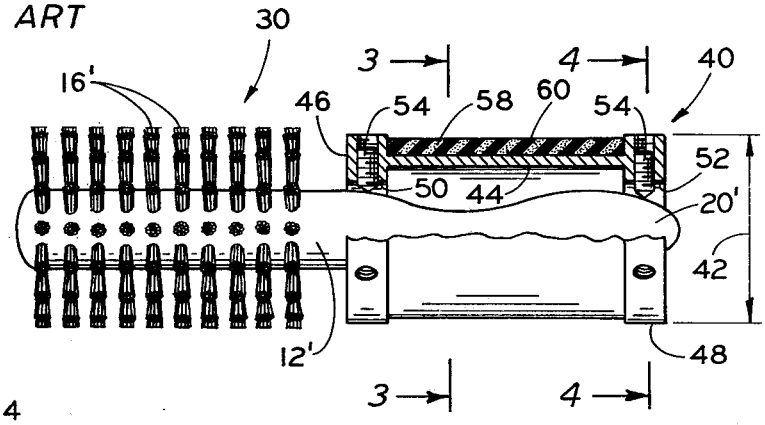
Figure 3:
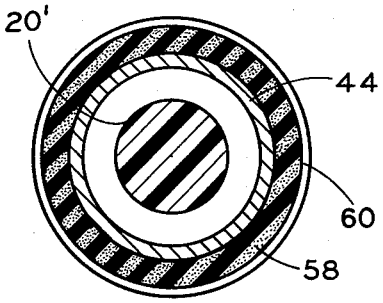
Figure 4:
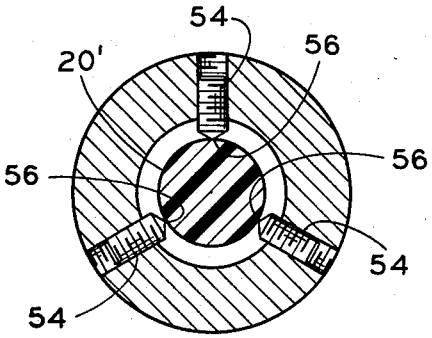
Figure 5:
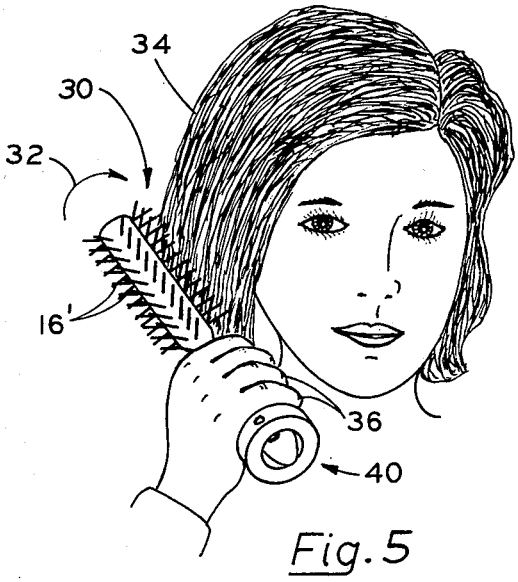

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a front elevational view of a conventional hair styling brush to which are applied the improvements of the present invention;

More particularly, FIGS. 2–5 illustrate an improved hair styling brush according to the present invention, and wherein said improved brush is evolved from the prior art brush of FIG. 1. More specifically, FIG. 2 is a front elevational view of the within improved brush in which portions of the handle construction thereof are partially broken away to better illustrate internal structural features thereof;

FIGS. 3 and 4 are side elevational views in section, taken respectively along lines 3—3 and 4—4 of FIG. 2, illustrating further structural details; and FIG. 5 illustrates typical use of the within improved hair styling brush.

As background, reference should be made to FIG. 1 illustrating a typical hair styling brush, generally designated 10, which, as understood, typically has a core 12 of wood or plastic material. Also, the typical construction of the prior art brush 10 contemplates that the core 12 extend the entire longitudinal length thereof, and that it be generally of a small-sized diameter (e.g. an inch), herein designated 14. At one end of the core 12 automated equipment is typically used to insert groups of hair bristles, individually and collectively designated 16, which then extend radially of the core 12. At the end opposite the radially extending bristles 16, the core 12 is typically provided with a handle shape, as at the locations 18, but said handle, generally designated 20, is still essentially embodied with the small-sized diameter 14 which it has been recognized in accordance with the present invention gives rise to major shortcomings in the use of the prior art brush 10.

More particularly, the small-sized diameter 14 of the core 12 is useful, if not necessary, in order to properly mount the bristles 12 in radial relation therefrom. However, it is an ill advised practice to merely extend the small-sized diameter core 12 in order to provide the handle 20 to the brush, and the consequence of this is that the prior art brush 10 suffers from significant shortcomings. That is, because the handle 20 is also small-diameter sized since it is a mere extension of the opposite portion which mounts the bristles 16, use of the prior art brush 10 contemplates that the user's fingers gripped about the handle 20 assume a small diameter or tight curvature that corresponds to the diameter 14. This small curvature in the user's fingers (not shown in FIG. 1) is the most significant cause of cramps that typically are experienced when using the prior art brush 10. Finger cramps, as just defined, usually not only cannot be avoided during any prolonged use of the prior art brush 10, but are a particularly serious problem at the very outset to a user who is hindered by arthritis or a similar physical infirmity.

Not only does the ill advised practice of using the extended length portion 20 of the small-diameter 14 of the core 12 result in discomfort in the use of the brush 10, as just noted, but the contemplated manner in which the brush is required to be used also aggravates the problem. As understood, brush 10, or more particularly the bristles 16 thereof, have to be rotated in brushing strokes through the user's hair and this of course requires the application of a rotative force at the brush handle 20. Since the brush handle 20 is of a comparatively small-sized diameter 14, the torque or rotative force which is applied at the free ends of the bristles 16 thus requires an unnecessarily greater force or exertion by the user when using a prior art handle 20 than that required using the within improved brush as will now be described. That is, and referring at this point in the description to FIG. 5, the within improved hair styling brush, generally designated 30, is more easily rotated through brushing strokes 32 through the user's hair 34 by an optimum minimum force or effort easily applied by the user via her hand or fingers 36 in gripping contact with an improved handle 40 for the hair styling brush 30 in accordance with the present invention, for reasons which soon will be apparent.

Handle 40 and the preferred manner in which it is applied to the within improved hair styling brush 30 can be readily appreciated by reference to FIGS. 2–4 to which figures reference should now be made. Briefly, brush 30, like the prior art brush 10, will be understood to have a small-diameter core 12' along the length of one end portion of which there is also appropriately mounted radially extending bristles 16'. However, in contrast to the prior art brush 10 of FIG. 1, the remaining length portion of core 12' (i.e. without the bristles 16'), which heretofore constituted the handle 20' is not used in practice as a handle for gripping and manipulating the brush 30 through ots brushing strokes in relation to the user's hair. Rather, appropriately mounted over and in encircling relation about and along the handle 20' is the improved attachment member or handle 40. The physical attribute contributed by the attachment member 40 is that it provides a significantly increased diameter (e.g. two inches), herein designated 42, for gripping and for manipulating the brush 30. That is, in a preferred embodiment, the diameter 42 will be understood to be at least as large as the diameter of the bristles 16'.

As may be appreciated best from FIGS. 3 and 4 in conjunction with FIG. 2, the attachment member or handle 40 includes a plastic cylindrical spool-like member 44 having bosses 46, 48 at opposite ends, each boss respectively having an internal opening 50 and 52.

The assembly of the attachment member 40 to the brush 30 contemplates insertion of the handle 20' through the openings 50 and 52 and, of course, the projection thereof centrally and longitudinally of the spool 44. The position of the spool 44 is then fixed on the handle 20' using threaded members, individually and collectively designated 54, which, as best shown in FIG. 4, are inserted in threaded openings radially and circumferentially spaced about the two end bosses 46 and 48 such that the members 54 can be threadably adjusted into holding contact, as at the locations 56, with the handle 20'. In this way, the external handle 40 is prevented from inadvertent rotative movement relative to the internal handle or core extension 20'.

To complete the handle or attachment member 40, an elastomeric sleeve 58 is stretched so as to facilitate it being positioned externally about the spool 44. Thus, the elastomeric sleeve 58 provides an external gripping surface 60 which, by its texture and resiliency, contributes to the comfort in the use of the brush 30. Thus, surface 60 is of a circular or cylindrical nature and is at the increased diameter 42 to thereby effectively obviate the shortcomings of the prior art brush 10. More particularly, the lager-sized diameter 42 in the gripping surface 60 allows for a much larger gripping curvature in the user's fingers 36, as illustrated in FIG. 5, and thus avoids finger cramping during ay prolonged use of the brush 10, and certainly enhances the use for any individual having arthritis or a similar physical infirmity.

It will of course be understood that the large-diameter handle 40, which obviates the shortcomings of the prior art hair styling brushes and also contributes to the enhanced use thereof as more particularly described herein, can be formed as an integral part of the brush as well as an attachment thereto in accordance with a preferred embodiment as herein described. In other respects as well, a latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A hair styling brush of the type having a cylindrical core of a first small-sized diameter extending for the longitudinal length thereof and having radially extending bristles along one end of said core and said opposite end of said core serving as a first gripping handle for said brush the improvement to said hair styling brush comprising a cylindrical attachment member of an elastomeric construction material in the gripping surface thereof having an operative position disposed as an external second gripping handle over and in encircling relation about said first gripping handle, said elastomeric attachment member having a comparatively large-sized diameter at least of the same size as said radially extending bristles and thus of an extent which correspondingly increases the curvature required in the fingers of the user when in gripping contact therewith incident to use of said brush so as to minimize cramping in said fingers, and wherein said large-sized diameter of said attachment member additionally contributes to enabling the rotation of said bristles of said brush in hair-brushing strokes in response to an optimum minimum rotative force.

* * * * *